United States Patent [19]

MacNeill

[11] 4,262,562

[45] Apr. 21, 1981

[54] GOLF SPIKE WRENCH AND HANDLE

[76] Inventor: Arden B. MacNeill, Sudbury, Mass.

[21] Appl. No.: 26,290

[22] Filed: Apr. 2, 1979

[51] Int. Cl.[3] ..... B25B 13/02

[52] U.S. Cl. ..... 81/90 C; 81/177 R

[58] Field of Search ..... 16/110 R, 114 R; 81/71, 81/90 R, 90 C, 90 D, 121 R, 177 R, 177 A, 177 B, 177 G; 135/65, 76

[56] References Cited

U.S. PATENT DOCUMENTS

| | | | |
|---|---|---|---|
| 340,738 | 4/1886 | Spare | 135/65 |
| 2,086,974 | 7/1937 | Belfore | 16/110 R X |
| 2,421,339 | 5/1947 | Leger | 16/110 R X |
| 2,801,852 | 8/1957 | Hottle | 81/90 C X |
| 2,881,648 | 4/1959 | Hottle | 81/90 C |
| 3,140,625 | 7/1964 | Pannozzo | 81/90 C X |
| 3,412,635 | 11/1968 | Chmielewski | 81/90 C |

FOREIGN PATENT DOCUMENTS

| | | | |
|---|---|---|---|
| 2380000 | 9/1978 | France | 135/65 |

*Primary Examiner*—James G. Smith

*Attorney, Agent, or Firm*—Herbert L. Gatewood

[57] ABSTRACT

A handle is provided of unique shape and profile suitable for use with a variety of means requiring a handle, e.g., a golf spike wrench, a screwdriver, and a corkscrew. In the case of a golf spike wrench, a wrench is provided that can be used with either hand, and that offers maximum support for the palm of one's hand. Through provision of a thumb rest on the golf spike wrench, pressure can be directed on the golf spike, facilitating removal or insertion of a spike into the sole of one's golf shoes. The golf spike wrench in accordance with the invention in the most preferred aspect includes a comoination handle and spike cleaner.

16 Claims, 4 Drawing Figures

GOLF SPIKE WRENCH AND HANDLE

BACKGROUND OF THE INVENTION

1. Field of Invention

This invention relates to a novel handle, to a golf spike wrench incorporating such a handle, and the combination of a golf spike wrench and spike cleaner.

2. Description of The Prior Art

Over the years, there have been developed a variety of golf spike wrenches for inserting and removing spikes from the soles of golf shoes. These wrenches have been of various construction; however, for the most part, they are essentially of a somewhat T-shaped cross-section, the cross bar of the T providing a handle or means for gripping with one's hand. At the other end of the stem of the T is located a so-called wrench assembly comprising two spaced-apart pins for association with two, correspondingly spaced-apart, holes in the golf spikes.

Golf spike wrenches such as above-described have been provided generally either entirely of metal, or partly of metal, i.e., only the stem and wrench assembly of metal, with a plastic handle. In the latter case, the handle provided in the golf spike wrenches of which I am aware are of two pieces riveted or otherwise joined together, e.g., by adhesive means. The stem, or shaft, and wrench assembly are, in some constructions, of one piece and in other constructions of two separate pieces. The stem of the golf spike wrench is usually of metal; however, the wrench assembly is sometimes of plastic, if the stem and wrench assembly are of two separate pieces.

In the case of the golf spike wrenches comprising an integral metal stem and wrench assembly, dead bores are usually drilled in the face of the assembly; afterwards, pins are pressed-fitted into the bores, these being for association with the correspondingly spaced-apart holes in the golf spikes.

Although golf spike wrenches such as are presently commercially available are satisfactory in their performance to a degree, their manufacture does, in some cases, require assembly, as well as a machining operation. Moreover, when the golf spike wrench, shaft, and handle are not an integral unit, this requires assembly of the handle with the shaft, and in some cases assembly of the wrench with the shaft. A major disadvantage with presently available golf spike wrenches is that, while the handle provides a somewhat satisfactory gripping means, it does not provide the optimum leverage for removing difficult to remove golf spikes. Neither does the handle configuration of the T-shaped handle provide means whereby inward pressure can be satisfactory exerted on inserting or removing a golf spike into or from the sole of the shoe.

With the plastic wrench assembly, the two wrench pins can be surrounded by plastic during the forming operation. Or dead bores can be machined into the plastic surface after formation of the plastic wrench assembly, followed by press-fitting of the pins into the dead bores. Nevertheless, the pressure exerted on the pins after repeated usage causes the pins to become loosened, and ultimately the wrench becomes unusable.

Another golf spike wrench presently available of which I am aware is essentially of the configuration of the ordinary screwdriver. The bit end of the wrench comprises two spaced-apart pins or prongs for association with the holes in the golf spike. This wrench, while simple in construction, is even somewhat less desirable than the other golf spike wrenches described above, as its particular handle construction does not result in the most desirable leverage to facilitate removal of hard to remove golf spikes.

On rainy days particularly, or when the ground is somewhat soft after a rain, a golfer's shoe bottom picks up dirt, grass, etc. After a while, there is so much accumulation between the golf spikes that this accumulation of dirt, grass, etc. must be removed from the shoe sole to provide better footing, and greater ease in walking. The removal of this accumulation is accomplished by a variety of means, depending somewhat upon the particular golfer, and the means at hand for digging away this accumulation. Oftentimes a screwdriver is used or the blade of a pocket knife. At other times, the golfer uses a golf tee to aid the removal of this accumulation. There is also available commercially at least one particular cleaning tool for this purpose. However, as far as I am aware, there is no tool available that provides a combination golf spike wrench and spike cleaner.

SUMMARY OF THE INVENTION

There is provided in accordance with the more basic aspects of my invention a handle of unique shape and profile suitable for use with a variety of means having a shaft requiring a handle, which can be used by either one's left or right hand and which offers maximum support for the palm of one's hand.

The handle construction of the invention basically comprises a vertically disposed shaft portion, a dead bore in the shaft portion for accommodation of a length of shaft, a universal gripping portion for gripping with one's palm extending from the shaft portion on one side and at an acute angle with respect to the center line of the shaft portion, and a thumb rest disposed away from the shaft portion and diametrically opposed to the gripping portion. Quite advantageously, the thumb rest makes it possible to exert inward pressure as desired on the handle while at the same time providing torque to the handle.

The handle of the invention can be used with a variety of means requiring a handle and, in particular, will be found quite useful where both inward pressure and rotational motion is desired, in the case of, for example, screwdrivers, corkscrews, and golf spike wrenches.

In its more specific aspects, the invention involves a golf spike wrench comprising a shaft incorporating such a handle as above-described at one end of the shaft and a wrench assembly at the other end. The wrench end assembly comprises in a specific aspect a body member, too spaced-apart wrench pins for association with the spaced-apart holes in a golf spike, and a pin cap in the bottom surface of the body member in combination with the wrench pins, for maintaining the wrench pins in permanent and fixed location.

Quite advantageously, the golf spike wrench according to the invention is not only simple in construction and manufacture, but offers improved performance and comfort to the user.

In an even more preferred aspect of the invention, the thumb rest is of such a construction that it functions not only as a thumb rest, but as a means for cleaning dirt, grass, etc. from between the spikes in the sole of a golf shoe. Thus, the invention in its more preferred aspects is a combination golf spike wrench and spike cleaner.

BRIEF DESCRIPTION OF THE DRAWINGS

The features of the invention will be better understood by reference to the accompanying drawings in connection with reading this specification in which.

DETAILED DESCRIPTION OF THE INVENTION AND THE PREFERRED EMBODIMENTS

Figure 1:
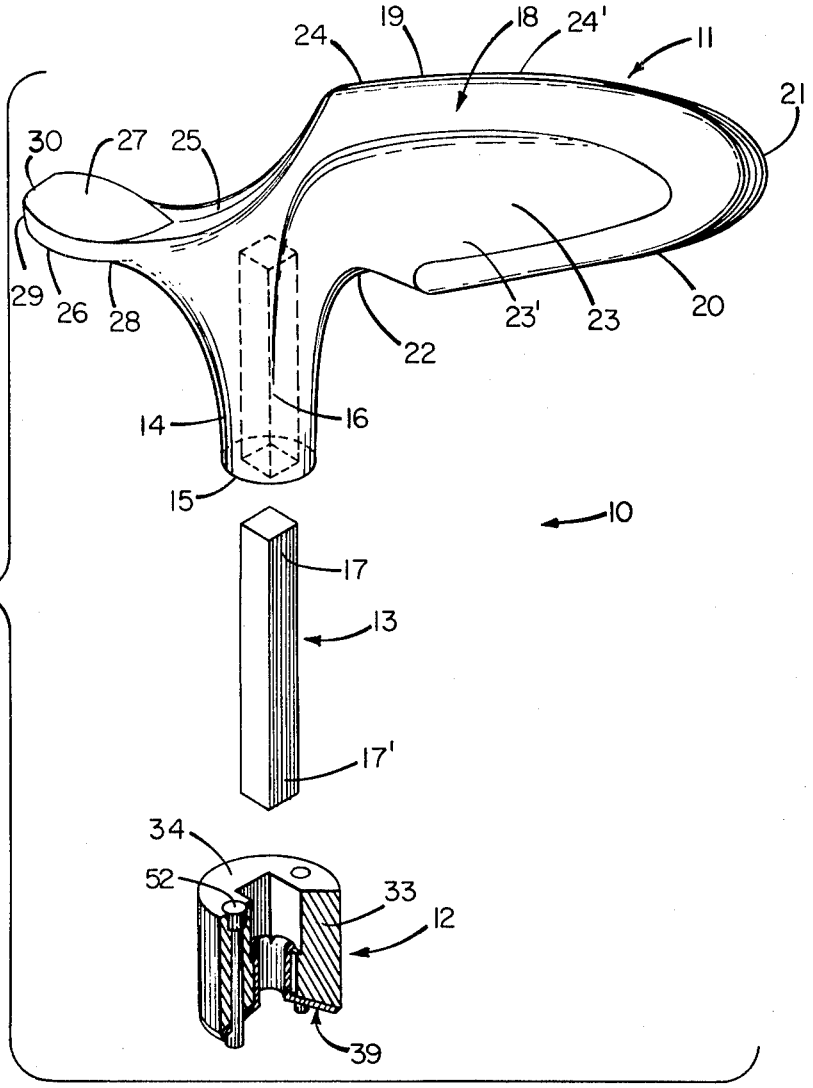
FIG. 1 is an exploded perspective view of a golf spike wrench in accordance with the invention.

Turning now to the drawing, there is shown in FIG. 1 thereof a golf spike wrench 10 comprising a handle 11, a wrench end assembly 12, and a shaft 13 connecting the handle to the wrench end assembly.

Handle 11, as shown by the drawing, comprises a vertically disposed shaft portion 14 the bottom of which is cylindrical shaped and defined by horizontally disposed face 15. Extending inwardly from face 15 for a suitable distance is dead bore 16 for accommodation of a suitable length of end 17 of shaft 13. As seen from the drawing, bore 16 and shaft 13 are of square cross-section configuration, to provide for positive rotational movement of shaft 13, when desired. However, it will be appreciated by those skilled in the art that bore 16 and shaft 13 can be of other than square cross-sectional configuration, provided positive, non-slipping engagement is obtained between the handle and shaft. In general, bore 16 and shaft 13 can be of any mating irregular cross-section, e.g., polygonal shape, undulating, or knurled shape. While not as desirable as the irregular shaped cross-section, bore 16 and shaft 13 can be even of circular shaped cross-section provided a tight fit is obtained and the handle and shaft are secured by adhesive or the like so as not to slip with respect to one another on application of torsional forces.

Extending from one side of shaft portion 14 of handle 11 is gripping portion 18, of suitable configuration and profile for gripping with the palm of either one's right or left hand, making it applicable for universal application. Gripping portion 18, as shown in the drawing, comprises a top 19 and a bottom 20, the top being of an arcuate shape, joining with the bottom 20 and providing a curved end 21 remote from shaft portion 14. Bottom 20, contrary to top 19, is straight or linear, from the end 21 toward the shaft portion 14, and is provided with a finger grip 22, adjacent its juncture with the shaft portion 14. Finger grip 22 curves upwardly from bottom 20, as shown, making a smooth curve with shaft portion 14.

Joining the top 19 and bottom 20 of gripping portion 18 are spaced-apart sidewalls 23,24, making a smooth-rounded curve with the top and bottom, which in cross-section are of arcuate shape. Thus, there are no sharp edges or projections on the gripping portion 18, to interfer with comfort in gripping. Optionally, sidewalls 23, 24 can be, as shown, provided with indentations 23' prime, 24' prime, curved slightly inwardly toward one another, providing locations for one's fingertips when gripping, regardless of whether gripping with the right or left hand. The indentations extend from adjacent shaft portion 14 to near the end 21.

As seen from the drawing, in particular, FIG. 1, gripping portion 18 is integral with shaft portion 14 and depends from it at an upwardly disposed angle. Measured from an imaginary center line extending along the shaft portion 14 and dead bore 16, gripping portion 18 extends at an acute angle with the vertical, as shown, providing a smooth curved portion 25 for a purpose later to be disclosed, joining gripping portion 18 with thumb rest 26. In cross-section curve portion 25 is of arcuate shape, blending smoothly into shaft portion 14.

Thumb rest 26 is integral with shaft portion 14 and extends essentially horizontally from it in a direction diametrically opposed to gripping portion 18. Thumb rest 26 has an upper surface 27 for supporting one's thumb which surface is generally flat or planar and curves only slightly upwardly from the horizontal. However, as will be appreciated, this surface could be concave, if desired, providing an indentation for one's thumb. Thumb rest 26, while essentially horizontally disposed can be disposed somewhat more vertically upwardly, if desired, and this may be somewhat more comfortable for some.

The underneath side 28 of thumb rest 26 is of arcuate cross-section and curves upwardly from shaft portion 14 providing a smooth intersection with upper surface 27. However, end portion 29 which intersects with upper surface 27 at an acute angle can be provided with a planar surface, making for a relatively sharp edge 30. Thus, there is provided a handy cleaning tool for use in cleaning accumulated grass and dirt from around the spikes and the sole of one's golf shoe. The cleaning blade provided by sharp edge 30 is, in general, about $\frac{1}{4}$ inch wide, more or less, as desired.

Figure 4:
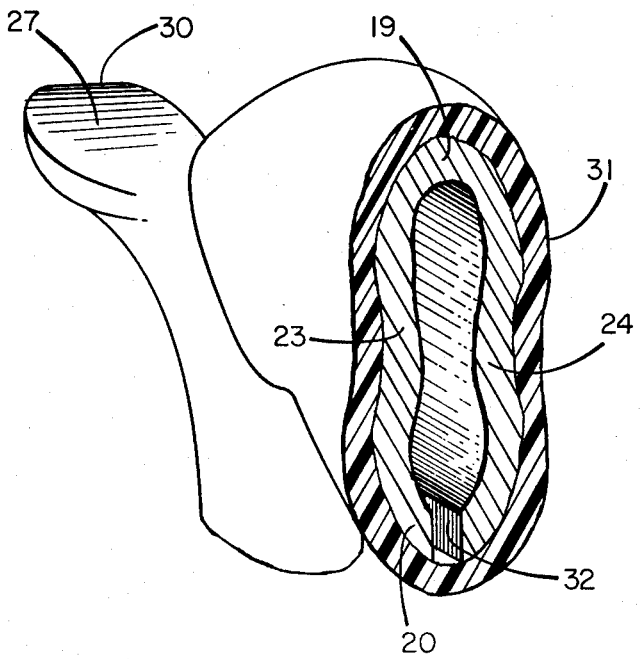
FIG. 4 is a cut-away view in perspective of another embodiment of the handle according to the invention.

As better seen from looking at FIG. 4, an outer-cover 31 may desirably be provided over gripping portion 18. Whether such a cover is actually used or not, depends somewhat on the manner of manufacture of handle 11. The handle can, of course, be manufactured by a variety of different techniques, e.g., various molding operations, machining from a solid piece, to name two, and from a variety of materials, e.g., wood, plastic, and metal.

The most desirable means of manufacture of handle 11, however, is by injection molding of suitable plastic material, e.g., ABS, cellulose acetate, polycarbonates, polyacetal resins, etc. This means of manufacture not only offers economy in production but permits the manufacture of a handle as a single one-piece unit, making possible the unique configuration disclosed.

While injection molding of a handle is most desirable, it is necessary as will be appreciated by those skilled in the art to provide a handle that comprises a hollow gripping portion. This not only provides economy in manufacture but maximum speed of the machine cycle. Thus, the design of the handle is such that the sidewalls of gripping portion 18 are kept to a minimum thickness, to conserve on material, yet provide a handle that is strong and durable. Adequate coring must be provided in the injection molding operation in accordance with usual molding techniques.

In the case where handle 11 is manufactured by injection molding, opening 32 in bottom 20 of gripping portion 18 is necessitated for removal of the core. The presence of opening 32 is undesirable from an appearance view point, thus the desirability in providing outer-cover 31. While cover 31 can be provided by various means, as will be appreciated, the most preferred is to encapsulate gripping portion 18 in a shrinkable plastic sleeve. Thus, a plastic sleeve or tube, open at one end only, can be provided according to usual techniques, essentially the shape of gripping portion 18. This sleeve is placed on gripping portion 18 subsequent to molding of handle 11, and heat shrunk thereon according to usual techniques. On shrinking, the plastic cover or sleeve 31 conforms to the contours and profile of the gripping portion, providing a more esthetically desirable handle. Various colored sleeves can be provided, as desired.

Figure 2:
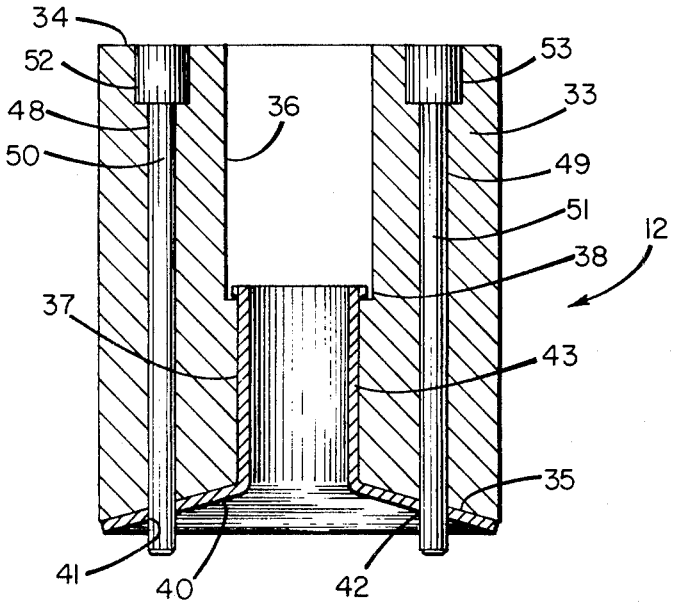
FIG. 2 is a view in cross section of the wrench end assembly.

Wrench end assembly 12, as seen more clearly by referring to FIG. 2 of the drawing, comprises a body member 33, desirably of cylindrical shape, having a top planar surface 34 and a bottom surface in the form of an inwardly projecting centrally disposed depression 35 having the shape of a right, hollow, truncated cone. Connecting these two surfaces together are concentric bores 36, 37, the first being of somewhat greater diameter than the latter, providing an internal shoulder 38, the purpose for which will be later explained, if not already obvious from the drawings.

As will be appreciated, bore 36 must be of such a length as to accommodate a suitable length of the end 17' of shaft 13. This bore, as is shaft 13, is of square cross-sectional configuration, providing for positive rotation of the wrench end assembly on rotation of handle 11. When handle 11 is assembled with wrench end assembly 12, shaft 13 is most preferably hidden, making it totally unnecessary that shaft 13 be ornamental, e.g., plated, for suitable appearance. Thus, shaft 13 can be merely cut the desired length from a straight piece of any conventional cold rolled steel square rod.

Shaft 13, as will be appreciated, provides a two fold purpose in the invention; it provides the needed torsional strength when tightening or loosening golf spikes and it holds handle 11 to wrench end assembly 12. Thus, it must not only be of suitable length to be hidden when the handle and wrench end assembly are assembled together, it must also be of sufficient cross-sectional dimension, compared to the dimension of the bores 16, 36, to provide a tight press fit.

Figure 3:
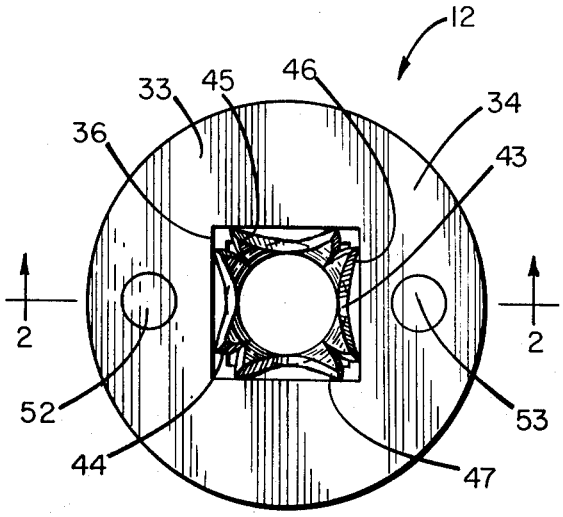
FIG. 3 is a top plan view of the wrench end assembly shown in FIG. 2.

In depressed bottom surface 35 of wrench end assembly 12 is pressed-fitted pin cap 39 comprising a right truncated, conical-shaped top 40 in which are provided pin holes 41, 42, and an elongated, centrally disposed tubular shaped body member 43. The tubular shaped body member 43, as shown, extends slightly beyond bore 37 into bore 36, being staked at the corners 44, 45, 46, and 47 of shoulder 38 by conventional techniques. This is accomplished by means of a square-shape lance type tool brought downward through bore 36, once pin cap 40 is brought into assembly with body member 33. The four corners of the lance press against the internal wall of the end of the cylindrical tubular body member 43, forcing metal of the tubular body member over against the four corners, as seen in FIG. 3. Thus, pin cap 39 is anchored in permanent position in body member 33.

Body member 33, on each side of centrally disposed, concentric bores 36, 37, is provided with diametrically opposed wrench pin bores 48, 49, which extend from top surface 34 to bottom 35. In these bores are provided wrench pins which comprise a cylindrical shaped elongated body member 50, 51, having cylindrical shaped heads 52, 53, respectively, of somewhat greater diameter. Thus, wrench pins 50, 51 are held securely in axial location, when wrench end assembly 12 is assembled with handle 11. As seen by reference to FIG. 2, wrench pins 50, 52, extend through holes 41, 42, in pin cap 39, and protrude beyond the front face of the pin cap a suitable length to engage with the correspondingly spaced-apart holes in conventional golf spikes. Wrench pin 50,51 and holes 41, 42 are of such respective diameters that wrench pins 50, 51 are in peripheral engagement with holes 41, 42. Thus, any lateral movement of the protruding tips of the wrench pins is prevented. Pin cap 39, as will be appreciated, maintains wrench pins 50,51, permanently in their desired spaced-apart location in the wrench end assembly 12, providing continued and long use.

Body member 33 is desirably made of a suitable strong, durable, plastic material such as above-described, and can be manufactured by conventional injection molding techniques. Pin cap 40 is manufactured from conventional, plated, steel strip, by deep drawing through a series of stations in a die and then, advancing in the same die, is formed into its cone shape. The wrench pin holes are pierced in a final operation. Wrench pins 50,51 are manufactured by cold heading from conventional wire of suitable diameter. Shaft 13 is merely cut to the proper length from a straight piece of cold rolled steel.

In assembling wrench end assembly 12, pin cap 39 is slipped into the circular bore 37 in the bottom surface 35 of the plastic body member 33, with the wrench pin holes 41,42, in alignment with wrench pin bores 48, 49. Wrench pins 50, 51 are then forced in from the top surface 34 into the wrench pin bores so that their heads 52,53 are flush with the top planar surface 34; the other ends of the wrench pins 50,51, will each protrude from the pin cap 39 the same distance, providing a suitable length of exposed pin to engage the matching holes in a golf spike.

Steel shaft 13 is then forced into the square dead bore 16 of handle 11, leaving a portion of the shaft protruding. This exposed portion of shaft 13, about one inch in length, is then forced into the square hole 36 in the top surface 34 of body member 33. When this is accomplished, top surface 34 will butt against face 15, leaving none of shaft 13 exposed. The golf spike wrench is then complete and ready for use in removing or inserting spikes in golf shoes.

The invention provides a golf spike wrench not only of stream-lined appearance but one providing improved performance in operation. The thumb rest provides means for application of downward pressure and in its most preferred aspect a combination spike cleaner. The finger grip provides a comfortable space for either the forefinger or the middle finger depending on the grip desired by the user. The curved portion connecting the gripping portion with the thumb rest provides a means of comfortably resting and supporting the underside of one's thumb, while applying downward pressure. The handle overall is of smooth contour, making for no sharp corners or projections interferring with the comfort of one's grip.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What I claim is:

1. Handle suitable for a variety of means comprising a shaft and requiring a handle comprising a vertically disposed shaft portion, a face defining the bottom of the shaft portion, a dead bore in said face extending inwardly therefrom for a pre-determined distance into said shaft portion for insertion of said shaft, an imaginary center line extending along said dead bore and shaft portion, a universal gripping portion for gripping with the palm of one's right or left hand extending from said shaft portion and disposed upwardly at an acute angle to said imaginary center line, a thumb rest extending from said shaft portion at a point below said gripping portion and in a direction directly opposite from said gripping portion, whereby one's thumb can be used in the application of pressure while gripping the handle.

2. Handle suitable for a variety of means comprising a shaft and requiring a handle according to claim 1 wherein said gripping portion is defined by an arcuate shaped top and a linear bottom, and a finger grip is provided in said bottom adjacent the juncture of the bottom with the shaft portion.

3. Handle suitable for a variety of means comprising a shaft and requiring a handle according to claim 2 wherein a curved portion joins said arcuate shaped top to said thumb rest whereby a means is provided for supporting one's thumb while applying downward pressure.

4. Golf spike wrench comprising a handle for gripping with one's hand, a wrench end assembly and a shaft connecting together said handle and said wrench end assembly wherein said handle comprises a vertically disposed shaft portion, a face defining the bottom of the shaft portion, a dead bore in said face extending inwardly therefrom for a predetermined distance into said shaft and for a predetermined length thereof, an imaginary center line extending along said dead bore and shaft portion, a universal gripping portion for gripping with the palm of one's right or left hand extending from said shaft portion and disposed at an acute angle to said imaginary center line, a thumb rest extending from said shaft portion in a direction directly opposite from said gripping portion whereby one's thumb can be used in the application of pressure inwardly against the golf spike while gripping and applying torque with the handle in removing or inserting golf spikes.

5. Golf spike wrench according to claim 4 wherein said wrench end assembly comprises a body member having a top surface and a bottom surface, a centrally disposed depression in said bottom surface having the shape in cross-section of a right truncated cone, a first centrally disposed bore of predetermined diameter extending inwardly from the bottom of said depression a predetermined distance towards said top surface, a second centrally disposed bore of predetermined greater diameter than said first bore and concentric therewith extending inwardly a predetermined distance from said top surface whereby shoulders are provided, wrench pin bores diametrically disposed on each side of said first and second bores extending from said top surface in said body member to said bottom surface, said wrench pin bores being of greater diameter adjacent said top surface than further away from the top surface, a pin cap comprising a truncated conical shaped top, two diametrically opposed holes in said top, and a centrally disposed hollow body member integral with and extending from said conical shaped top being located in the said depression so that said hollow body member intrudes into said bore and slightly beyond, said hollow body member being staked at its free end with said shoulder whereby said pin cap is permanently secured to said body member, cylindrical shaped wrench pins located in said wrench pin bores comprising a cylindrical shaped head and a cylindrical shaped body, said cylindrical shaped body extending through said two holes in said pin cap a sufficient distance to engage with the corresponding holes in a golf spike whereby pin cap maintains said pins in a predetermined spaced-apart location.

6. Golf spike wrench according to claim 5 wherein said top and bottom surfaces, and said face are all planar and parallel with one another whereby in assembly said face and said top surface are in abutting contact with one another so that said shaft is hidden from view and said wrench pins are secured in said body member.

7. Golf spike wrench according to claim 6 wherein said dead bore is of a square shape.

8. Golf spike wrench according to claim 7 wherein said shaft is of a square cross-sectional configuration.

9. Golf spike wrench according to claim 4 wherein said gripping portion comprises a top and a bottom, and a finger grip is provided in said bottom where said gripping portion meets with the shaft portion.

10. Golf spike wrench according to claim 9 wherein a smooth curve connects said thumb rest with said top of the gripping portion providing a rest for the underside of one's entire thumb while gripping the gripping portion.

11. Golf spike wrench according to claim 10 wherein said thumb rest comprises a planar top surface for resting the end of one's thumb.

12. Golf spike wrench according to claim 11 wherein a second planar surface is provided which joins with said planar thumb rest from the bottom and which provides a sharp edge suitable for use in cleaning dirt and grass from between the golf spikes in the sole of a golf shoe.

13. Golf spike wrench according to claim 4 wherein said gripping portion comprises a top and bottom, and spaced apart sidewalls connecting said top and bottom, said top being of an arcuate shape providing a somewhat smooth rounded shape for gripping with one's palm.

14. Golf spike wrench according to claim 13 wherein the top of the said gripping portion curves downwardly toward said bottom providing a curved end remote from said shaft portion.

15. Golf spike wrench according to claim 4 wherein a cover is provided on said gripping portion.

16. Golf spike wrench according to claim 15 wherein said cover is a plastic cover which has been heat shrunk on to said gripping portion to conform to the contours of the gripping portion.

* * * * *